US008528989B2

(12) United States Patent
Halverson et al.

(10) Patent No.: US 8,528,989 B2
(45) Date of Patent: Sep. 10, 2013

(54) METHOD FOR SIMULTANEOUSLY MINING VERTICALLY DISPOSED BEDS

(75) Inventors: Duane S. Halverson, Green River, WY (US); Wesley K. Nash, Jr., Green River, WY (US)

(73) Assignee: FMC Corporation, Philadelphia, PA (US)

( * ) Notice: Subject to any disclaimer, the term of this patent is extended or adjusted under 35 U.S.C. 154(b) by 462 days.

(21) Appl. No.: 12/711,282

(22) Filed: Feb. 24, 2010

(65) Prior Publication Data

US 2010/0225154 A1 Sep. 9, 2010

Related U.S. Application Data

(60) Provisional application No. 61/209,310, filed on Mar. 5, 2009.

(51) Int. Cl.
*E21B 43/28* (2006.01)

(52) U.S. Cl.
USPC ..... 299/4

(58) Field of Classification Search
USPC ..... 299/4, 5
See application file for complete search history.

(56) References Cited

U.S. PATENT DOCUMENTS

| | | | | | |
|---|---|---|---|---|---|
| 2,919,909 | A * | 1/1960 | Rule | 299/4 |
| 3,058,730 | A * | 10/1962 | Bays | 299/4 |
| 3,184,287 | A * | 5/1965 | Gancy | 423/198 |
| 3,271,962 | A * | 9/1966 | Dahms et al. | 299/4 |
| 3,510,167 | A * | 5/1970 | Carmody | 299/4 |
| 3,612,608 | A * | 10/1971 | Manker et al. | 299/4 |
| 3,778,108 | A | 12/1973 | Pennington et al. | |
| 5,246,273 | A * | 9/1993 | Rosar | 299/4 |
| 5,690,390 | A * | 11/1997 | Bithell | 299/4 |
| 6,889,781 | B2 | 5/2005 | Mazorow | |
| 6,964,303 | B2 | 11/2005 | Mazorow et al. | |
| 2002/0023781 | A1 * | 2/2002 | Peters | 175/67 |
| 2003/0164253 | A1 * | 9/2003 | Trueman et al. | 175/67 |

OTHER PUBLICATIONS

Advanced Resources International for the US EPA under contract 68-W-00-094, Directional Drilling Technology [online] www.epa.gov/cmop/docs/dir-drilling.pdf, Dec. 2, 2002.

* cited by examiner

*Primary Examiner* — John Kreck
(74) *Attorney, Agent, or Firm* — FMC Corporation

(57) ABSTRACT

A method of solution mining vertically disposed beds of water-soluble deposits comprising a lower bed and at least one upper bed having at least one non-soluble layer disposed therebetween, said method comprising the steps of: (a) forming a channel in the lower bed; (b) drilling at least one zero radius or ultra-short radius injection pathway in the at least one upper bed; (c) manipulating at least one of the channel and the at least one injection pathway such that a fluid pathway is established between said channel and at least one injection pathway; (d) injecting a stream of solvent through the at least one injection pathway; and (e) recovering the solvent containing dissolved deposit therein via a recovery well.

14 Claims, 1 Drawing Sheet

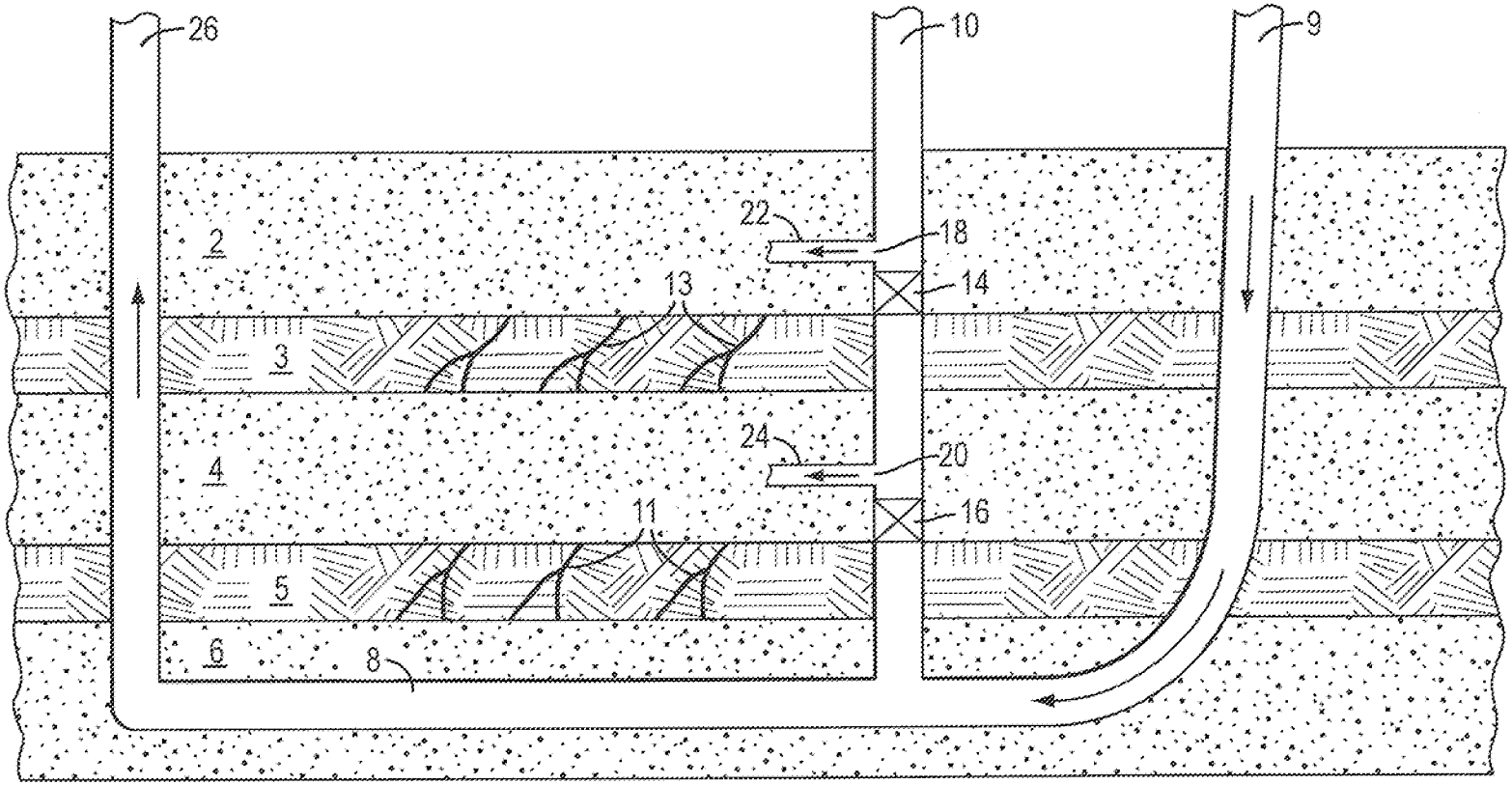
9
10
26
18
14
20
16
22
24
13
11
8
2
3
4
5
6

METHOD FOR SIMULTANEOUSLY MINING VERTICALLY DISPOSED BEDS

FIELD OF THE INVENTION

The present invention is directed to a process for simultaneously mining vertically disposed beds of soluble deposits having an insoluble layer disposed therebetween. This process provides an economical and safe method for mining commercially valuable saline minerals, such as trona, from beds which have, in the past, largely constituted un- or under-utilized resources

BACKGROUND OF THE INVENTION

Many saline materials, such as trona, borates, potash and sodium chloride, are obtained by commercial mining processes. The largest known deposit of trona ($Na_2CO_3.NaHCO_3.2H_2O$) is located in southwestern Wyoming, in the vicinity of Green River. Other such underground deposits of trona have been discovered in Turkey and China. According to U.S. Pat. No. 5,690,390, the main trona bed at Green River is present as a seam about 12 feet in thickness at a depth of approximately 1500 feet. The Green River trona beds cover approximately 1000 square miles and comprise many different beds which generally overlap each other and are separated by layers of shale. In some areas, ten or more layers of trona may be present.

Trona is mined and then processed into various sodium alkali products, including refined soda ash, a significant ingredient in the manufacture of glass. In the past, materials such as trona were primarily recovered employing dry mining processes. The dry mining of trona ore may be accomplished through various techniques utilizing longwall mining, borer mining, and drum mining machinery. However, even with major equipment and productivity improvements having been made over the years, dry mining of the underground trona deposits is still labor intensive, hazardous and therefore expensive. Beyond this, some beds are too thin and/or of insufficient purity to be economically extracted by conventional mechanical mining techniques.

In order to overcome the costs and difficulties associated with such dry mining, methods for the solution mining of trona, and for the subsequent processing of the trona solutions, have been proposed. While these solution mining methods may be effective to recover trona or other soluble materials from a single bed or multiple beds with thin interburden, they do not cost effectively address the capture of such materials from multiple vertically disposed beds interlaid with thick insoluble layers and/or layers of undesirable impurities.

Accordingly, there is a need for an improved method to recover saline materials, such as trona, from multiple vertically disposed beds.

SUMMARY OF THE INVENTION

The present invention is directed to a method of solution mining vertically disposed beds of soluble deposits comprising a lower bed and at least one upper bed having at least one insoluble layer disposed therebetween, said method comprising the steps of: (a) forming a channel in the lower bed; (b) drilling at least one zero radius or ultra-short radius injection pathway in the at least one upper bed; (c) manipulating at least one of the channel and the at least one injection pathway such that a fluid pathway is established between said channel and at least one injection pathway; (d) injecting a stream of solvent through the at least one injection pathway; and (e) recovering the solvent containing dissolved deposit therein via a recovery well.

This method provides a means to safely and economically recover valuable saline materials, such as trona, from multiple vertically disposed beds.

BRIEF DESCRIPTION OF THE DRAWING

FIG. 1 shows an elevational view, not drawn to scale, of one embodiment of the method of this invention in which zero radius lateral injection pathways, drilled via a vertical injection well, are employed to mine beds positioned above a lower bed through which a channel exists.

DETAILED DESCRIPTION OF THE INVENTION

The present invention is directed to a method of solution mining vertically disposed beds of soluble deposits comprising a lower bed and at least one upper bed having at least one insoluble layer disposed therebetween, said method comprising the steps of:

(a) forming a channel in the lower bed;
(b) drilling at least one zero radius or ultra-short radius injection pathway in the at least one upper bed;
(c) manipulating at least one of the channel and the at least one injection pathway such that a fluid pathway is established between said channel and at least one injection pathway;
(d) injecting a stream of solvent through the at least one injection pathway; and
(e) recovering the solvent containing dissolved deposit therein via a recovery well.

It is to be understood that the order in which steps (a) and (b) are performed is not critical; and that, in certain embodiments, the manipulation of such channel or such injection pathway in step (c) could be commenced prior to the formation of the other component of such fluid pathway (e.g., the channel could be expanded by solution mining prior to the drilling of the injection pathway).

As is employed herein, the term "zero radius injective pathway" refers to a pathway having a zero foot radius which may be formed by methods employing a telescopic probe with a hydraulic jet, or by other means well known to those of skill in the art such as perforating the casing or "perfing". The term "ultra-short radius injective pathway" refers to a pathway having a radius of between about 0.5 and about 5.0 feet which may be formed by methods employing coiled tubing with a hydraulic jet, or by other means well known to those of skill in the art. See, for example "Directional Drilling Technology", available on the United States Environmental Protection website at www.epa.gov/coalbed/docs/dir-drilling-.pdf. It is to be noted that lateral distances greater than those indicated in this publication can be achieved.

Referring to FIG. 1, which shows one preferred embodiment of the present invention, upper beds 2 and 4 are vertically disposed over lower bed 6. Such beds may be composed of any soluble saline substance found in multiple-bed formations including trona, nahcolite, borates, potash and sodium chloride. In one preferred embodiment, the method is used to mine trona, which is then removed from solution and converted into sodium carbonate by means well known to those of skill in the art.

Insoluble level 3 is disposed between beds 2 and 4, while insoluble layer 5 is disposed between beds 4 and 6. Typically, such insoluble layers will be composed of shale or a similar material.

Lower bed 6 contains channel 8, which in the embodiment pictured is formed by long radius directional drilling. Medium radius directional drilling may alternatively be employed. The terms "medium radius" and "long radius " drilling are well known to those of skill in the art. Although the EPA website provided above defines "medium radius" as having a radius of between 300 and 500 feet; and "long radius" as between 1,800 and 2,800 feet; it will be understood that wells having radii longer, shorter or between these figures may be employed. In alternative embodiments (not pictured), channel 8 could be formed by mechanical mining or other processes.

Channel 8 is manipulated in such a manner that at least one fluid pathway is established between lower bed 6 and upper bed 4. Typically such manipulation involves the removal of sufficient amounts of bed material (e.g. trona) by methods such as solution mining. Due to the differences in compressive strength of bed 4 (trona has a compressive strength of about 7,500 psi) and the insoluble layer 5 (shale has a compressive strength of about 3,700 psi), the expansion of channel 8 resulting from such solution mining will typically result in the creation of cracks 11 in insoluble layer 5, which cracks may extend into upper bed 4. Alternatively and or additionally, such manipulation may result in the delamination of portions of lower bed 6 and/or the caving in of sections of insoluble layer 5.

Vertical injection well 10 is drilled vertically through beds 2 and 4, and extends into channel 8 in lower bed 6. In alternative embodiments, one or several vertical injection wells may be drilled. Such wells may not extend to lower bed 6 in all embodiments, or in some situations, if desired, some of the wells could be drilled into lower bed 6 while others extend only to upper beds 2 and/or 4. In alternate embodiments, an injection pathway may be drilled through the side of the initial long or medium radius injection well such that a solvent pathway is created in an upper bed.

Flow restricting or shut off means 14 and 16 "packers" are disposed inside vertical injection well 10. Alternately, individual piping strings could be set into the well through packing devices and the flow to each zone regulated by valves installed at the surface, allowing for precise control of the flow rate into a given cavity. The injection flow rates into each soluble mineral bed may be manipulated to preferentially avoid deposits of undesirable soluble minerals, such as Halite, and/or to maximize concentration of the desired mineral in the extracted solvent. Such manipulation of injection flow rate and location can be done independently or in conjunction with a movement of the extraction location amongst the various beds.

Flow restricting or shut off means 14 and 16 are disposed below side holes 18 and 20 respectively. Such side holes may be bored into vertical injection well 10 using methods and equipment such as that disclosed in U.S. Pat. Nos. 6,889,781 and 6,964,303. High pressure water nozzles at the end of a hose are inserted into side holes 18 and 20. Injection of water or an aqueous solvent through such nozzles cuts zero radius injection pathways 22 and 24 into soluble beds 2 and 4, respectively.

Vertical recovery well 26 is drilled so that it intersects with channel 8. Downhole pumps or other devices may be attached to recovery well 26 to manipulate the pressure in channel 8 or the level of the solvent within the formation. In an alternate embodiment, the recovery and injection zones might be moved upward to higher beds. This would be the case in a circumstance where injection and recovery from the lower bed has resulted in the cavity encountering a region containing an undesirable constituent. A specific case would be encountering a large Halite (NaCl) deposit within a given trona bed. Alternatively, the recovery zone could be lowered in order to avoid region(s) containing undesirable constituents in upper beds.

If desired, a "rathole" extending below the level of the mine floor could be drilled at the site of the extraction well. If present, such a rathole should preferably extend deep enough to provide enough submergence to pull the solvent down to the mine floor level. This could have the effect of depressurizing the channel and thereby helping to induce caving.

In the practice of the method of this invention, as embodied in FIG. 1, channel 8 is cut through lower bed 6 via long radius directional drilling.

Channel 8 is manipulated by injecting a first stream of water or another suitable aqueous solvent through long radius directional injection well 9 into channel 8. Solvent passing through channel 8 will, due to the large surface area created by the dissolution process present, constitute high density brine by the time it reaches extraction well 26. This solution mining of lower bed 6 will widen channel 8 and will eventually cause cracks 11 in insoluble layer 5 to develop, thereby establishing at least one fluid pathway between upper bed 4 and channel 8.

A second stream of water or another suitable aqueous solvent is injected through first vertical injection well 10 and into layer 4 through zero radius injection pathway 24. Solvent pumped through zero radius injection pathway 24 will percolate through cracks 11 in insoluble layer 5, eventually flowing into channel 8. As channel 8 expands due to dissolution of lower bed 6, such cracks will eventually expand and cause caving in of level 5, thereby increasing the exposure and dissolution rate of upper bed 4.

The fluid pathway between zero radius injection pathway 24 and channel 8 can be created or expanded by the manipulation of such pathway 24 and/or channel 8 by various methods, such as:

(a) Creating pressure swings in such chambers by varying the flow rates of the first solvent stream and/or second solvent stream, respectively;

(b) Creating a cavity in upper bed 4 by dissolution if no connection is made during the initial drilling of zero radius injection pathway 24. This may be accomplished by pumping solvent (such as hot water or caustic) through the jet/hose to form a larger cavity in the upper bed. The trona dissolved during this process would return up the annular space around the hose to the surface. A larger cavity would provide additional surface area in the upper cavity for the pressure to work on. The resulting increase in force towards the de-pressurized lower cavity would increase the likelihood of a cave-in resulting in a flow connection; or (c) Using hot water or caustic solution as the solvent for cutting zero radius injection pathway 24 into upper bed 4. This would increase the rate at which the pathway is formed and would increase its tendency to preferentially cut through the water soluble trona versus the insoluble shale layers.

(d) lowering the level of the solvent in the lower channel to reduce the pressure and supporting force on the roof of the channel, thereby increasing the tendency for the roof to collapse and form fractures that connect to the upper injection pathway.

As upper bed 4 is dissolves, cracks 13 will begin to appear in shale level 3. Solvent may then be passed through zero radius injection pathway 22 by manipulation of flow or shut-off means 14. Such solvent will begin to dissolve saline layer 2 and percolate through cracks 13, eventually flowing into channel 8. The dissolved saline may then be recovered via recovery well 26. This process may be repeated sequentially to recover trona or other soluble saline material from several vertically disposed beds.

What is claimed is:

1. A method of simultaneously solution mining vertically disposed beds of soluble deposits comprising a lower bed and at least one upper bed having at least one insoluble layer disposed therebetween, said method comprising the steps of:

(a) forming a channel in the lower bed;

(b) drilling at least one zero radius or ultra-short radius injection pathway in the at least one upper bed;

(c) manipulating at least one of the channel and the at least one injection pathway such that a fluid pathway is established between said channel and at least one injection pathway;

(d) injecting a stream of solvent through the at least one injection pathway; and (e) recovering the solvent containing dissolved deposit therein via a recovery well.

2. The method of claim 1 wherein said deposits comprise trona.

3. The method of claim 1 wherein the channel of step (a) is formed by long radius or medium radius directional drilling.

4. The method of claim 1 wherein the manipulation in step (c) comprises the creation of pressure swings in the channel and/or the at least one injection pathway by varying the flow rates of first solvent stream injected into the channel and/or a second solvent stream injected into the at least one injection pathway, respectively.

5. The method of claim 1 wherein hot water is injected in step (d).

6. The method of claim 1 wherein caustic solution is injected in step (d).

7. The method of claim 1 wherein the manipulation in step (c) comprises lowering the level of the solvent in the lower channel to reduce the pressure and supporting force on the roof of the channel, thereby increasing the tendency for the roof to collapse and form fractures that connect to the upper injection pathway.

8. A method of simultaneously solution mining vertically disposed beds of soluble deposits comprising a lower bed and at least one upper bed having at least one insoluble layer disposed therebetween, said method comprising the steps of:

(a) forming a channel in the lower bed;

(b) drilling at least one zero radius or ultra-short radius injection pathway in the at least one upper bed which pathway extends in a direction parallel to that of the channel;

(c) manipulating at least one of the channel and the at least one injection pathway such that a fluid pathway is established between said channel and at least one injection pathway;

(d) injecting a stream of solvent through the at least one injection pathway; and (e) recovering the solvent containing dissolved deposit therein via a recovery well.

9. The method of claim 8 wherein said deposits comprise trona.

10. The method of claim 8 wherein the channel of step (a) is formed by long radius or medium radius directional drilling.

11. The method of claim 1 wherein the manipulation in step (c) comprises the creation of pressure swings in the channel and/or the at least one injection pathway by varying the flow rates of a first solvent stream injected into the channel and/or a second solvent stream injected into the at least one injection pathway, respectively.

12. The method of claim 8 wherein hot water is injected in step (d).

13. The method of claim 8 wherein caustic solution is injected in step (d).

14. The method of claim 8 wherein the manipulation in step (c) comprises lowering the level of the solvent in the lower channel to reduce the pressure and supporting force on the roof of the channel, thereby increasing the tendency for the roof to collapse and form fractures that connect to the upper injection pathway.

* * * * *